US006146738A

United States Patent [19]

Tsuji et al.

[11] Patent Number: 6,146,738

[45] Date of Patent: Nov. 14, 2000

[54] FEMALE MEMBER OF MECHANICAL FASTENER

[75] Inventors: Tomoko Tsuji; Hisashi Takai, both of Kagawa-ken, Japan

[73] Assignee: Uni-Charm Corporation, Japan

[21] Appl. No.: 09/183,512

[22] Filed: Oct. 30, 1998

[30] Foreign Application Priority Data

Oct. 31, 1997 [JP] Japan ..... 9-300858

[51] Int. Cl.[7] ..... A44B 21/00; A44B 18/00; B32B 3/06

[52] U.S. Cl. ..... 428/99; 428/175; 428/182; 24/442

[58] Field of Search ..... 428/99, 175, 182; 24/442, 448

[56] References Cited

U.S. PATENT DOCUMENTS 2,627,644 2/1953 Foster ..... 428/175
5,032,122 7/1991 Noel et al. ..... 24/442
5,380,313 1/1995 Goulait et al. .

FOREIGN PATENT DOCUMENTS 0 341 993 11/1989 European Pat. Off. .
2-18036 1/1990 Japan .

*Primary Examiner*—Alexander S. Thomas
*Attorney, Agent, or Firm*—Baker & Daniels

[57] ABSTRACT

A female member of a mechanical fastener includes a fibrous layer and a plurality of strips. A plurality of ridges are intermittently shaped from a bottom side toward a top side of the fibrous layer. A plurality of strips are bonded to the bottom side of the fibrous layer so as to be spaced one from another and extend in parallel one to another in one direction so that the bottom side of the fibrous layer is spaced toward the top side of the fibrous layer from the respective strips along the respective ridges.

6 Claims, 3 Drawing Sheets

FEMALE MEMBER OF MECHANICAL FASTENER

BACKGROUND OF THE INVENTION

This invention relates to a female member of a mechanical fastener consisting a pair of male and female members adapted to be releasably engaged with each other.

Japanese Patent Application Disclosure Gazette (Kokai) No. Hei2-18036 discloses an example of such a female member, in which a fibrous layer having a fineness of 1~10 d and a basis weight of 5~200 g/m$^2$ is laminated on a plastic film having a thickness of approximately 0.025~0.13 mm and in which the fibrous layer form a corrugated structure. In this corrugated structure, regions of the fibrous layer projecting from the plastic film engageably receive a male member (referred to also as a hook member) of the mechanical fastener.

When an article to which the mechanical fastener is attached includes clothes and other garments such as diapers, it is often desired that at least one of the female and male members is as soft as possible to avoid a problem that this member might irritate a wearer's skin. Sometimes, it is also desired for this member to have a sufficiently low rigidity to allow clothes or the like to which this member is attached to be easily deformed. Such requirement should be met particularly when the mechanical fastener is employed in disposable diapers for babies. However, with the conventional female member as described above, the fibrous layer forming the corrugated structure might lose its initial softness and become rigid due to the presence of the plastic film.

SUMMARY OF THE INVENTION

In view of the above problem, it is a an object of the invention to improve a softness of the conventional mechanical fastener consisting of a plastic film and a fibrous layer.

According to the invention, there is provided a female member of a mechanical fastener consisting of a pair of male and female members adapted to be releasably engaged with each other, wherein: a region of the female member for engagement with the male member is formed by a fibrous layer of thermoplastic synthetic fibers and has top and bottom sides; and a plurality of thermoplastic synthetic resin strips are bonded to the bottom side of the fibrous layer so as to extend in parallel one to another in one direction and a plurality of ridges are shaped from the bottom side toward the top side of the fibrous layer intermittently in the one direction so that the bottom side of the fibrous layer is spaced toward the top side of the fibrous layer from the strips.

According to one of preferred embodiments of the invention, the ridges are arranged intermittently also in a direction orthogonal to the one direction.

According to another embodiment of the invention, the ridges extend continuously in a direction orthogonal to the one direction.

According to still another embodiment of the invention, the fibrous layer is made of crimped conjugated fibers.

According to further another embodiment of the invention, the fibrous layer presents a corrugated structure having the strips bonded to the bottom thereof side along respective trough-like portions thereof.

According to still further another embodiment of the invention, the fibrous layer is made of a nonwoven fabric.

DESCRIPTION OF THE PREFERRED EMBODIMENTS

Details of a female member according to the invention as a component of a mechanical fastener will be more fully understood from the description given hereunder with reference to the accompanying drawings.

Figure 1:
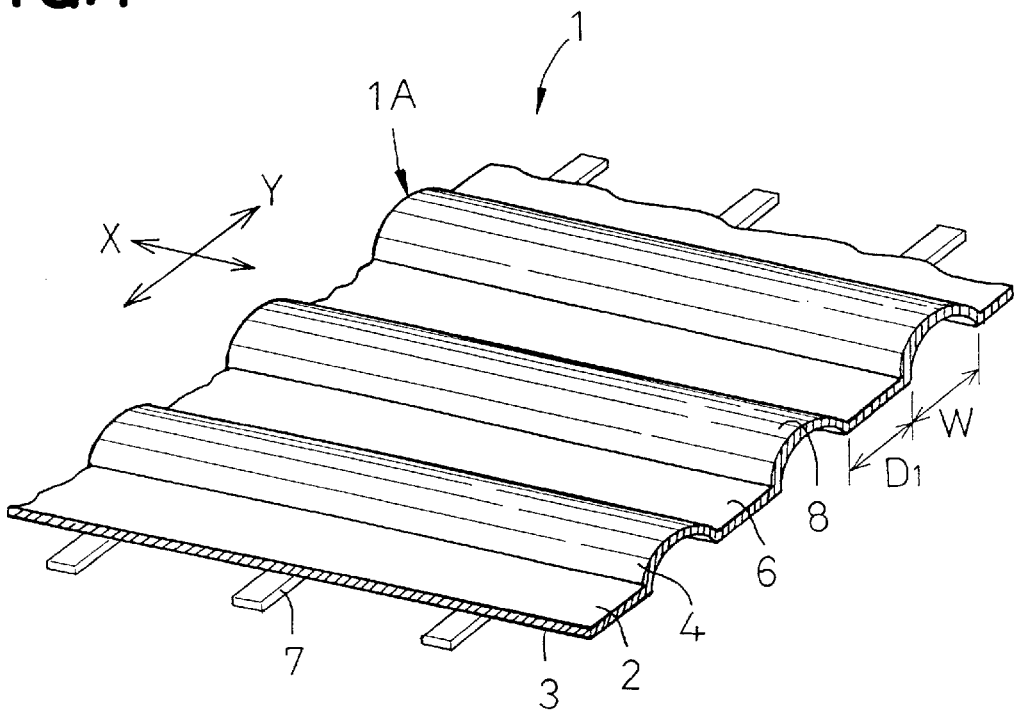
FIG. 1 is a perspective view depicting an embodiment of female member according to the invention as a component of a mechanical fastener as viewed from above.
Figure 2:
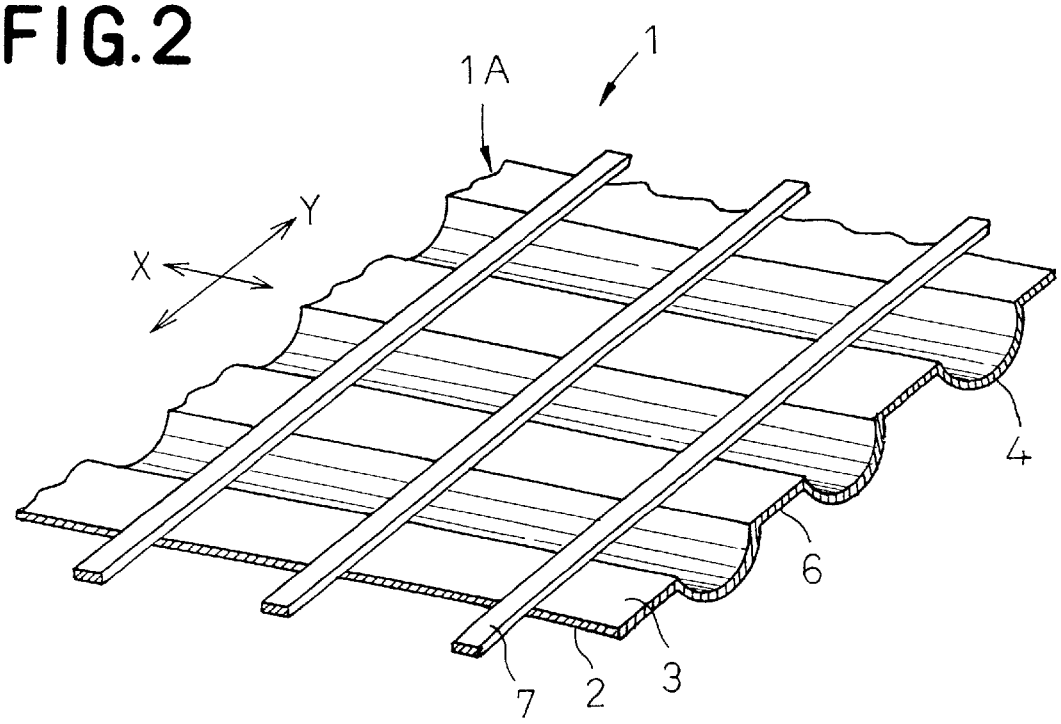
FIG. 2 is a perspective view depicting the female member depicted by FIG. 1 as viewed from below.

FIGS. 1 and 2 are perspective views of a female member 1, depicting its top and bottom sides 2, 3, respectively. The female member 1 comprises a shaped component 1A made of a fibrous layer of thermoplastic synthetic fibers and strips 7 made from a thermoplastic synthetic resin. The shaped component 1A presents a so-called corrugated structure or the like. A plurality of ridges 4 shaped from the bottom side 3 toward the top side 3 extend in a direction as indicated by a double-headed arrow X and the ridges 4 are arranged intermittently in a direction as indicated by a double-headed arrow Y being orthogonal to the direction X. Each pair of the adjacent ridges 4 are connected to each other by a flat portion 6. On the bottom side 3, a plurality of the strips 7 extending in the direction Y are arranged intermittently in the direction X. The strips 7 extend substantially in parallel one to another and heat-sealed or bonded by means of a gluing agent or an adhesive agent such as hot melt adhesive to the bottom side 3 at the flat portions 6.

To obtain the female member 1 of such a configuration, a fibrous layer such as a nonwoven fabric of thermoplastic synthetic staple fibers or continuous filaments which are entangled or melt-bonded with each other to be engageable with the male (hook) member, more preferably of crimped conjugated fibers, having a fineness of 0.5~15 d and a basis weight of 10~100 g/m$^2$ may be employed as the fibrous layer as material for the shaped component 1A. Each of the ridges 6 may have a height of 1~10 mm, more preferably of 2~5 mm as measured from the flat portion 6 to a crest 8 thereof and a width of 2~10 mm, more preferably of 3~7 mm as measured in the direction Y.

Each of the strips 7 as the other component of the female member 1 may have a width of 0.5~7 mm, more preferably of 1~5 mm and a thickness of 0.01~0.2 mm, more preferably of approximately 0.02~0.1 mm. Each pair of the adjacent strips 7 may be spaced from each other by 0.3~10 mm, more preferably by 0.5~5 mm. The strips 7 may be heat-sealed or bonded by means of a gluing agent or an adhesive agent such as hot melt adhesive to the bottom side of the shaped component 1A at the respective flat portions 6.

The female member 1 may be attached to an article with the bottom side 3 thereof being stitched to the article or bonded to the article by means of a gluing agent or an adhesive agent at said flat portions 6. With the female member 1 attached to the article in this way, a male member of the mechanical fastener is to be releasably engaged. The male member can be most reliably engaged with the ridges 4 of the female member 1. The shaped component 1A is effectively prevented from being stretched in the direction Y by the strips 7 bonded thereto since the strips 7 are arranged so as to be intermittent in the direction X and continuous in the direction Y. Accordingly, the ridges 4 can maintain their initial heights. On the other hand, the shaped component 1A is relatively flexible in the direction X as well as in the direction Y without being significantly restricted by the strips 7. In other words, the member 1 can follow a deformation of the article such as clothes and therefore does not deteriorate feeling to wear such article.

Figure 3:
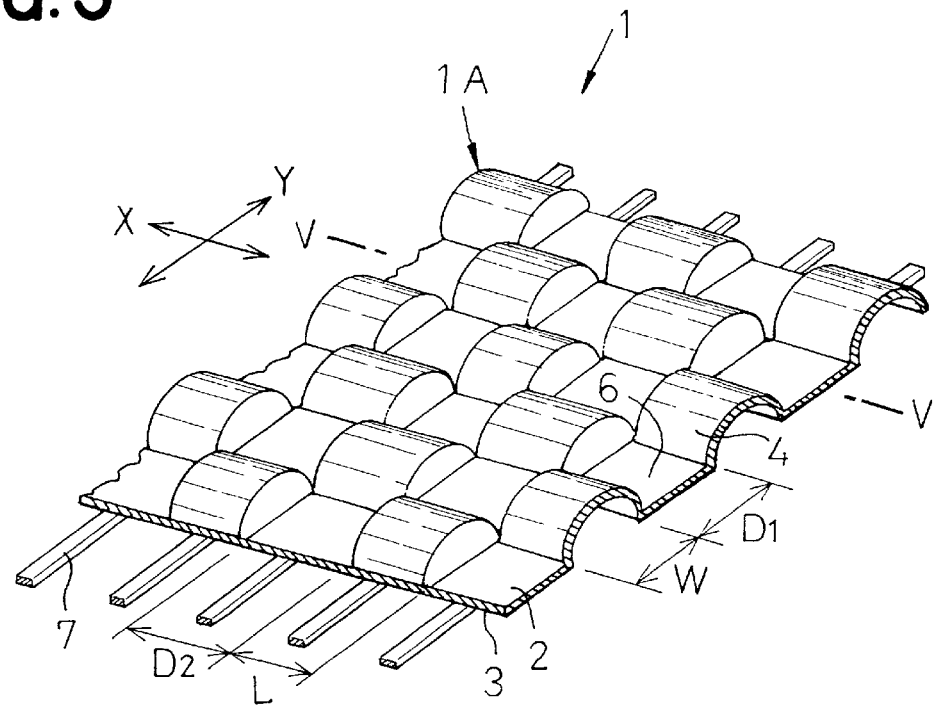
FIG. 3 is a view similar to FIG. 1 depicting a variant of the female member depicted by FIG. 1.
Figure 4:
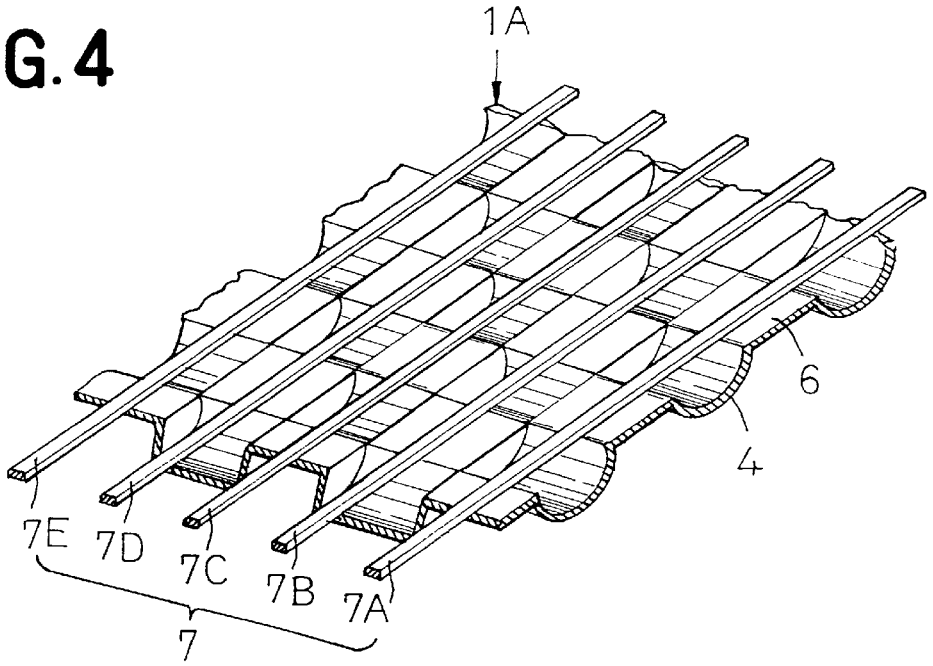
FIG. 4 is a perspective view depicting the variant shown by FIG. 3 as viewed from below.
Figure 5:
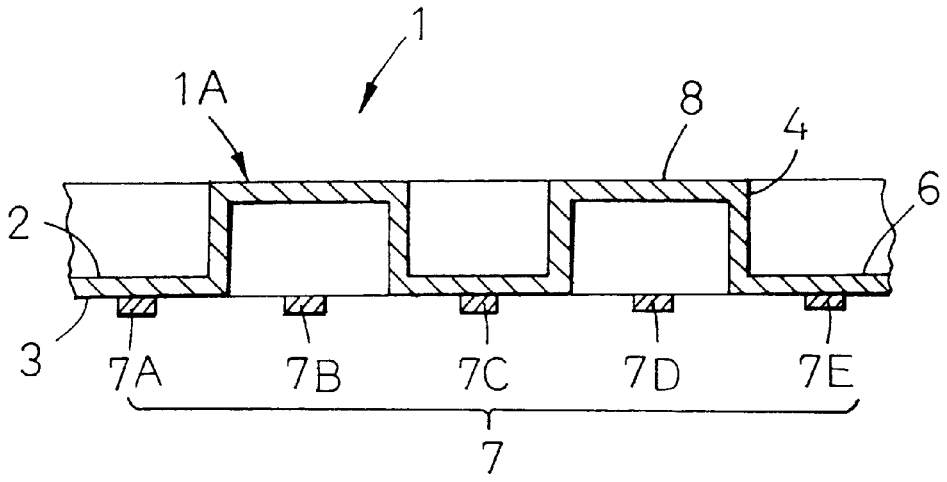
FIG. 5 is a sectional view taken along a line V—V in FIG. 3.

FIGS. 3, 4 and 5 illustrate a variant of the female member according to the invention, in which FIGS. 3 and 4 are perspective views similar to FIGS. 1 and 2, and FIG. 5 is a sectional view taken along a line V—V in FIG. 3. According to this embodiment of the female member 1, the ridges 4 are arranged intermittently in the direction X as well as in the direction Y. Each of the ridges 4 has a length L of 2 mm or larger and each pair of the adjacent ridges 4 are spaced from each other by distances $D_1$, $D_2$ of 0~10 mm, more preferably of 2~7 mm. Each of the ridges 4 has a width W of 2~10 mm, more preferably of 3~7 mm. The strips 7 are dimensioned in the same manner as in the case illustrated by FIG. 2 and each of the strips 7 is assigned to each row along which the ridges 4 and the flat portions 6 are alternately arranged in the direction Y. The strips 7 assigned to the respective rows are designated by 7A, 7B, . . . , 7E. It should be understood that some of the strips 7A~7E, for example, the strips 7B and 7D may be eliminated without departing from the spirit and the effect of the invention. Specifically, the remaining strips 7A, 7C, 7E can sufficiently prevent the shaped component 1A from being stretched in the direction Y and thereby achieve the same effect as in the case of FIG. 1. The female member 1 according to this embodiment may further facilitate the male member to be engaged with the female member 1 than in the case illustrated by FIG. 1 since the ridges 4 are arranged intermittently in the direction X as well as in the direction Y.

The female member 1 according to the invention may be obtained, for example, by a method comprising the steps of thermo-embossing the nonwoven fabric of thermoplastic synthetic fibers to form the ridges 4 and the flat portions 6 and pressure-heat-sealing a plurality of the strips 7 discharged from an extruder against the bottom sides of the respective flat portions 6 before the strips 7 are hardened.

According to the important feature of the invention, the fibrous layer includes a plurality of the ridges arranged intermittently on its top side and a plurality of the thermoplastic synthetic resin strips intermittently bonded to the bottom side of the fibrous layer so as to be spaced one from another and to extend in parallel one to another. The ridges facilitate the male member to be engaged with the female member and the arrangement of the strips are effective to prevent the ridges from being deformed due to stretch of the shaped fibrous layer as well as from losing its initial flexibility. In this manner, the female member as one component of the mechanical fastener is relatively flexible and, when it is used with clothes, well follows deformation thereof without creating a feeling of discomfort against a wearer.

What is claimed is:

1. A female member of a mechanical fastener having male and female members which are adapted to be releasable engaged with each other, said female member comprising:

a nonwoven fibrous layer of thermoplastic synthetic fibers having top and bottom sides;

a plurality of thermoplastic synthetic resin strips bonded to said bottom side of said the nonwoven fibrous layer so as to extend in parallel one to another in one direction; and a plurality of ridges formed in said nonwoven fibrous layer which are shaped from said bottom side toward said top side thereof intermittently in said one direction so that portions of said bottom side of said nonwoven fibrous layer are spaced toward said top side of said nonwoven fibrous layer from said strips.

2. A female member according to claim 1, wherein said ridges are arranged intermittently also in a direction orthogonal to said one direction.

3. A female member according to claim 1, wherein said ridges extend continuously in a direction orthogonal to said one direction.

4. A female member according to claim 1, wherein said fibrous layer is made of crimped conjugated fiber.

5. A female member according to claim 4, wherein said nonwoven fibrous layer has a corrugated structure having said strips bonded to a bottom side thereof along respective trough-shaped portions thereof.

6. A female member according to claim 1, wherein said fibrous layer has a corrugated structure having said strips bonded to a bottom side thereof along respective trough-shaped portions thereof.

* * * * *